US005115660A

United States Patent [19]

Kurobe et al.

[11] Patent Number: 5,115,660

[45] Date of Patent: May 26, 1992

[54] METHOD FOR MAKING BAND PLATES DEFORMED IN SECTION

[75] Inventors: Jun Kurobe; Kenji Hara; Masayuki Ishihara; Kazuhiro Takagi, all of Sakai, Japan

[73] Assignee: Nisshin Steel Co., Ltd., Tokyo, Japan

[21] Appl. No.: 570,779

[22] Filed: Aug. 22, 1990

[30] Foreign Application Priority Data

Sep. 4, 1989 [JP] Japan ..... 1-227601

[51] Int. Cl.[5] ..... B21B 1/36; B21D 31/00

[52] U.S. Cl. ..... 72/197; 72/198; 72/229; 72/363; 29/17.4

[58] Field of Search ..... 29/17.1, 17.2, 17.3, 29/17.4, 17.5, 17.6, 17.7, 17.8, 17.9; 72/362, 363, 365.2, 366.2, 377, 379, 181, 184, 191, 197, 198, 229

[56] References Cited

U.S. PATENT DOCUMENTS

| | | | |
|---|---|---|---|
| 1,106,172 | 8/1914 | Wetcke | 72/197 |
| 1,568,050 | 1/1926 | Budd | 72/198 |
| 2,051,018 | 8/1936 | Umansky | 72/229 |
| 2,434,558 | 1/1948 | Gage et al. | 72/363 |
| 2,709,933 | 6/1955 | Reed | 72/363 |
| 3,195,333 | 7/1965 | McDaniel | 29/17.9 |

FOREIGN PATENT DOCUMENTS

| | | | |
|---|---|---|---|
| 0044422 | 11/1972 | Japan | 72/363 |
| 0094505 | 5/1984 | Japan | 72/363 |
| 0064701 | 4/1985 | Japan | 72/366.2 |
| 0138003 | 5/1989 | Japan | 72/363 |
| 0590127 | 1/1978 | U.S.S.R. | 72/363 |

*Primary Examiner*—Lowell A. Larson
*Assistant Examiner*—Thomas C. Schoeffler
*Attorney, Agent, or Firm*—Fleit, Jacobson, Cohn, Price, Holman & Stern

[57] ABSTRACT

A method for making sectionally deformed band plate feeds by cold-rolling metal band plate feeds between work rolls wherein at least one of the work rolls has a barrel provided with a circumferential groove, a plurality of metal band plate feeds with substantially equal resistance to deformation, while overlaid one upon another, are rolled together between the work rolls to a reduction ratio of 30% or lower at one feeding operation, and the resulting metal band plate feeds are separated from each other.

5 Claims, 3 Drawing Sheets

METHOD FOR MAKING BAND PLATES DEFORMED IN SECTION

BACKGROUND OF THE INVENTION

1. Field of the Invention

The present invention relates to a method for making band plate feeds deformed in section, which are varied stepwisely in thickness in their widthwise direction by cold rolling.

2. Prior Art

A sectionally deformed band plate feed 2 in which a metal plate feed 2*a* is stepped at 2*b* on its one side, as illustrated in FIG. 7 by way of example—hereinafter simply called a deformed band plate feed—finds use in wide applications such as connectors' contactors, relays' contactors and terminals for lapping connection.

Hitherto, such deformed band plate feeds have been typically made by the following techniques.

(1) Cutting

A metal band plate feed of rectangular shape in section is fed in its longitudinal direction, during which it is continuously cut in its preselected, widthwise positions by cutting or milling.

(2) Intermittent Rolling

As set forth in Japanese Patent Publication No. 53(1978)-27234, a metal band plate feed to be rolled is fed between a reciprocating flat roll and a mold provided on its side facing said flat roll with a projection or recess having a gradually increasing width, during which a certain pressure is applied to the flat roll to form on the band plate feed steps following the surface geometry of the mold.

However, a problem with the former cutting technique are that swarfs produced in cutting the metal band plate feed does not only make working environment worse but also lowers yields due to increased material losses. Another problem arises in connection with the quality of products, since they leave burrs, warps, etc. on their cut ends. The latter intermittent rolling technique, on the other hand, has difficulty in making variously deformed band plate feeds, since it needs costly molds. Another drawback with this technique is that the production efficiency is very low due to difficulty encountered in making deformed band plate feeds continuously.

In addition to the above techniques, there is another rolling technique in which one metal band plate feed to be rolled is fed between a pair of work rolls, at least one of which includes a barrel provided with a circumferential groove, thereby making a deformed band plate feed deformed. According to this technique, however, rolling is effected with a pair of rollers which are of the same diameter and the work rolls rotate at the same peripheral speed, so that the metal band plate feeds are largely elongated in the rolling direction. There is thus a large difference in length in the rolling direction between the rolled and unrolled portions, giving rise to undulations on the rolled portion. Such undulations become more marked at a higher reduction ratio.

In view of such problems of the prior art as mentioned above, a primary object of the present invention is to provide a method for efficiently making satisfactory band plate feeds deformed in section, which can be practiced with improved yields but without causing swarfs, burrs and undulations.

SUMMARY OF THE INVENTION

As a result of studies made to solve the above problems, it has been found that the preferable to improve yields and production efficiency is cold rolling in which a metal band plate feeds are fed between opposing work rolls, and that a large difference in rolling length between unrolled and rolled portions is caused by the fact that the feeds are less deformed in the direction perpendicular to its rolling direction. Further, it has been found that if a plurality of metal band plate feeds with substantially equal resistance to deformation, while overlaid one upon another, are cold-rolled between work rolls to a reduction ratio of 30% or lower at one feeding operation, then it is possible to increase frictional force occurring on the side of the metal band plate feeds opposite to their side engaging the work rolls, so that their elongation in the rolling direction can be limited with their widthwise deformation taking place. This has led to another finding that sectionally deformed thin band plate feeds can be made with causing neither undulations on them nor cladding of them between the opposing work rolls.

According to the present invention, there is provided a method for making sectionally deformed band plate feeds by cold-rolling metal band plate feeds between work rolls, wherein at least one of said work rolls has a barrel provided with a circumferential groove a plurality of metal band plate feeds with substantially equal resistance to deformation, while overlaid one upon another, are rolled together between said work rolls to a reduction ratio of 30% or lower at one feeding operation and the resulting metal band plate feeds are separated from each other.

BRIEF DESCRIPTION OF THE DRAWINGS

The method for making sectionally deformed band plate feeds deformed in accordance with the present invention will now be described, by way of example, with reference to the accompanying drawings in which.

DETAILED DESCRIPTION OF THE PREFERRED EMBODIMENTS

Figure 1:
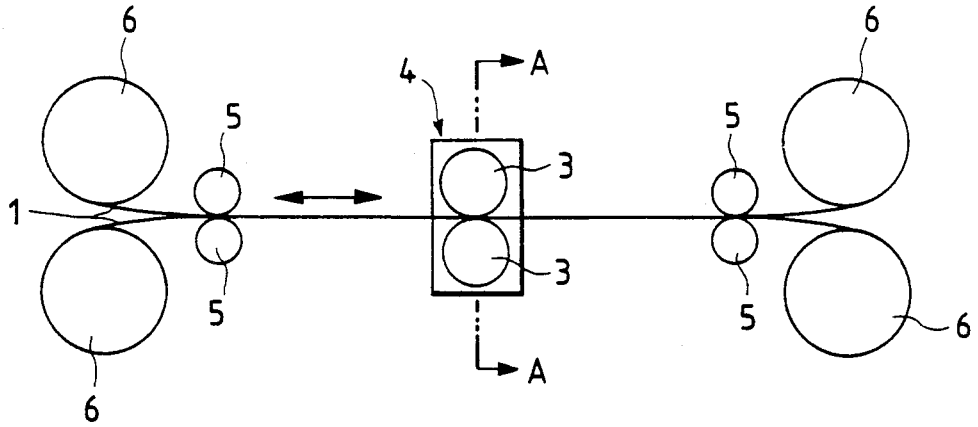
FIG. 1 is a schematic view illustrating one embodiment of carrying out the method of the present invention.

In order to carry out the method of the present invention, a rolling stand 4 is provided, which includes a pair of opposing work rolls 3 at positions where a metal band plate feed 1 is located between the work rolls on its both sides. A gap, shown at 3*b*, between the work rolls 3 housed within the rolling stand 4 is such that the reduction ratio of the band plate feed 1 rolled between them at one operation is 30% or lower. At least one of the work rolls 3 has to include a barrel provided with a circumferential groove 3*a*. The other roll 3 may preferably be provided with a groove 3*a* of the same width at a position corresponding to that of the groove 3*a* of the one work roll 3. Alternatively, a flat work roll without a groove on the barrel may preferably be used.

One metal band plate feed 1 is fed with another one or more metal band plate feeds 1 overlaid on it between the work rolls 3 housed within the rolling stand 4. The metal band plate feeds 1 are preferably of the same material. However, different materials with substantially equal resistance to deformation may also be rolled.

Figure 2:
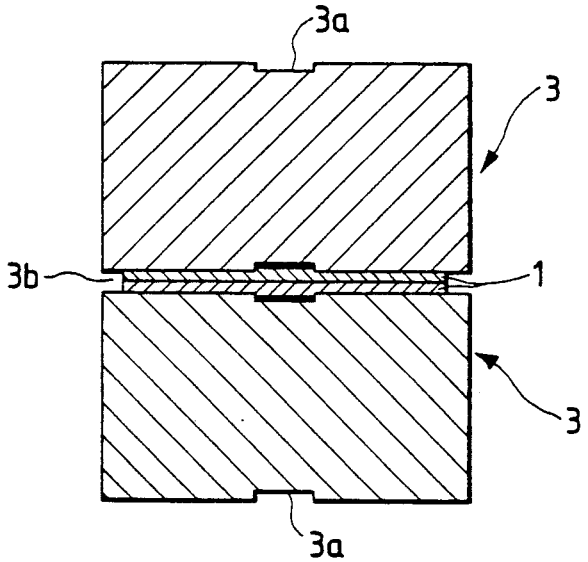
FIG. 2 is an enlarged end view of part taken along the line A—A of FIG. 1.
Figure 3:
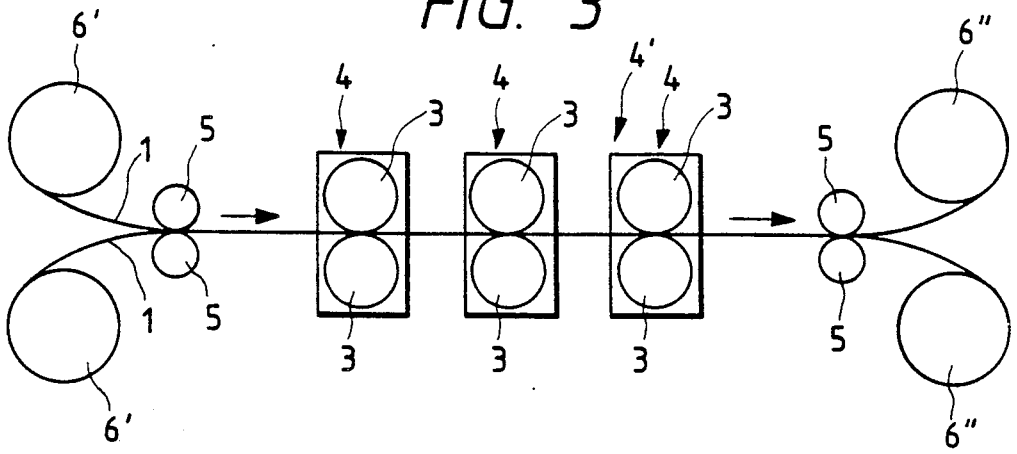
FIG. 3 is a schematic view illustrating another embodiment of carrying out the method of the present invention.
Figure 4:
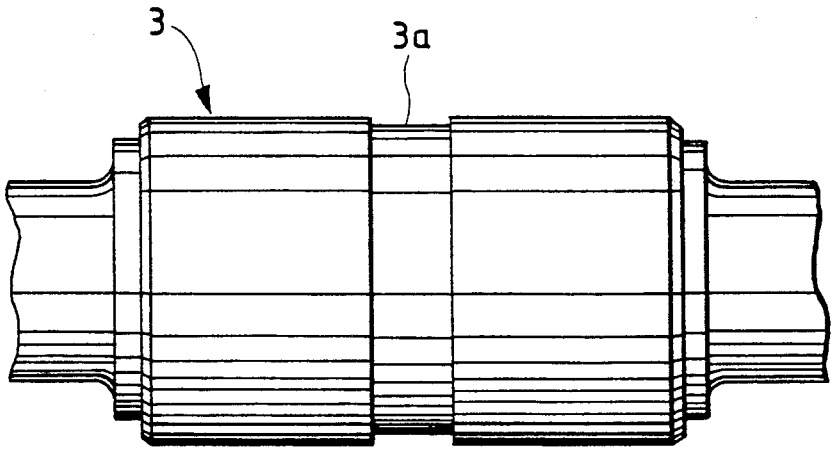
FIG. 4 is an enlarged front view showing one example of a work roll in engagement with a metal band plate feed to be rolled.

If the final reduction ratio is 30% or lower in making the deformed band plate feeds 2, a plurality of the metal band plate feeds 1, put one upon another, may then be rolled between a set of the opposing work rolls 3 at one feeding or passing operation. If the final reduction ratio exceeds 30%, on the other hand, use may then be made of a reverse rolling technique in which, as illustrated in FIG. 1, pay-off and take-up reels 6 are provided in the number of pairs corresponding to the number of the metal band plate feeds 1 put one upon another are provided on both sides of one rolling stand 4 through two pairs of deflector rolls 5, respectively. The metal band plate feeds 1 are fed from one pair of pay-off and take-up reels 6 through the associated pair of deflector rolls 5 between the work rolls 3 housed in the rolling stand 4, from which they are fed onto the other pair of pay-off and take-up reels 6 through the associated pair of deflector rolls 5. After the gap 3*b* in FIG. 2 between the work rolls 3 housed in the rolling stand 4 is reduced, the metal band plate feeds 1 are then rolled back between the work rolls 3. This operation is repeated, as desired. Alternatively, the reduction ratio may be regulated to 30% or lower at one feeding operation between work rolls 3 of a tandem-rolling operation. As illustrated in FIG. 3 pay-off reels 6' and take-up reels 6'' are provided in the number of pairs corresponding to the number of the metal band plate feeds 1 are provided on both sides of a rolling stand group 4' comprising a plurality of rolling stands 4, each housing a pair of work rolls 3, through two pairs of deflector rolls 5. Gaps, shown at 3*b* in FIG. 2, between the respective pairs of work rolls 3 are designed to narrow gradually in the direction shown by an arrow. The metal band plate feeds 1 are fed from one pair of pay-off reels 6' located on the side of the rolling stand 4 housing a pair of work rolls 3 having the largest gap 3*b* through the associated pair of deflector rolls 5 into the rolling stand group 4', from which they are in turn fed onto the other pair of take-up reels 6'' through the associated pair of deflector rolls 5.

In this manner, a plurality of the metal band plate feeds 1 to be rolled are rolled between the work rolls 3 to a given size. Thereafter, the metal band plate feeds 1 overlaid one upon another are taken up by either one of the pairs of pay-off and take-up reels 6 or take-up reels 6'' to separate the metal band plate feeds from each other, as shown in FIG. 1 or 3.

According to the method of the present invention, a plurality of flat metal band plate feeds 1 are rolled together between a pair of work rolls 3 having their barrels each provided with a circumferential groove 3*a*. The metal band plate feeds 1 first engage the portions of the work rolls 3 in which no grooves 3*a* are present, whereby only those portions are rolled. Thus, steps are formed on the metal band plate feeds 1 accordingly, thereby making the deformed band plate feeds 2 having steps in their widthwise direction. Since increased frictional force occurs between the metal band plate feeds 1 at the time of rolling in the direction of rolling, thereby increasing a certain component of such forces in the rolling direction some limitation is placed on the portions, to be rolled, of the metal band plate feeds which tend to be rolled in the rolling direction, so that they can be deformed largely in their widthwise direction.

Further, since the metal band plate feeds 1 are rolled together between a set of the opposing work rolls 3 to a reduction ratio of 30% or lower and at one feeding operation, they are unlikely to be cladded even when overlaid one upon another.

Example

Figure 5:
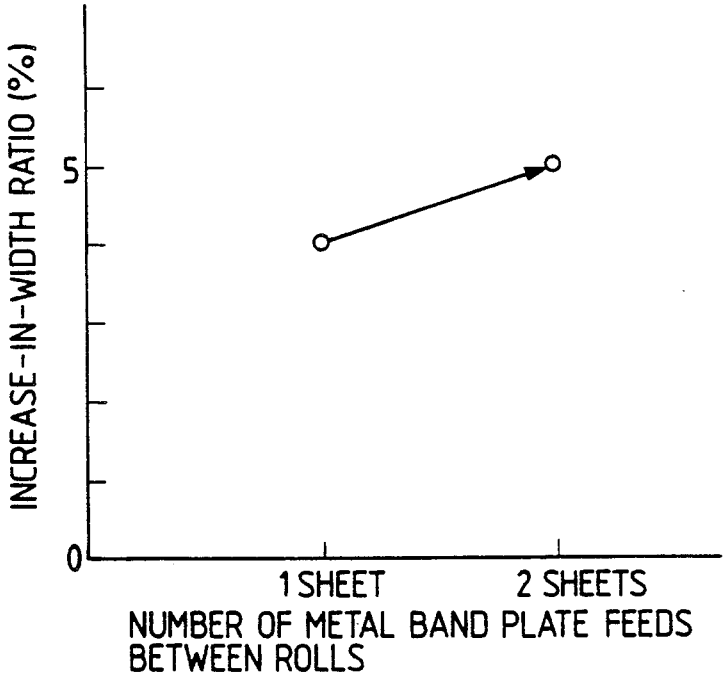
FIG. 5 is a graph showing an increase-in-width ratio obtained when one pure-copper band plate feed is rolled alone and with another one overlaid on it.
Figure 6:
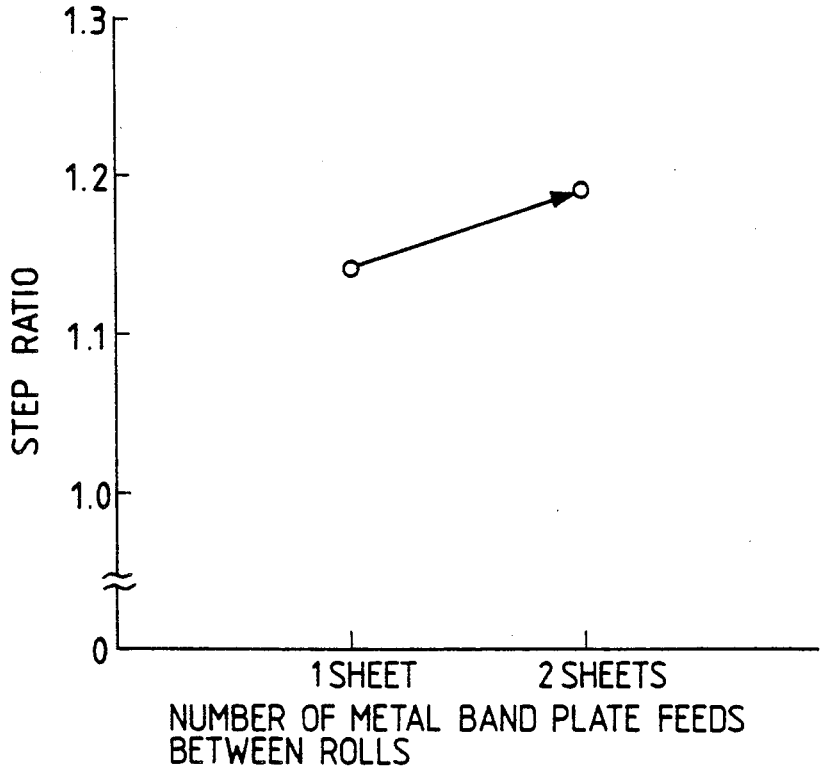
FIG. 6 is a graph showing a step ratio obtained when one pure-copper band plate feed is rolled alone and with another one overlaid on it.
Figure 7:
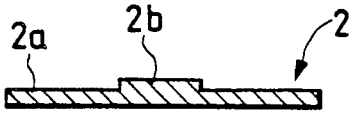
FIG. 7 is a cross-sectional view of a known type of sectionally deformed band plate feed.

While overlaid one upon another, two pure-copper band plate feeds, each of 3 mm in thickness and 30 mm in width, were rolled together between a set of opposing work rolls having a diameter of 70 mm and length of barrel 120 mm, one having a barrel provided with a 18-mm wide and 1-mm deep groove in its axial center and the other defined by a flat work roll, to a reduction ratio of 20% at a peripheral speed of 4.5 m/min. and at one feeding operation without using any rolling oil. For the purpose of comparison, a single pure-copper band plate feed of the same dimensions was rolled under the same conditions as mentioned above. As a result, it turned out that the band plate feeds rolled according to the present invention were higher in both the ratio of an increase-in-width (see FIG. 5) and the step ratio or the ratio of the thickness of unrolled portions to the thickness of rolled portions (see FIG. 6) than the band plate feeds ralled in comparative example.

As detailed above, the present invention provides a method for efficiently making improved band plate feeds deformed in section with improved yields but without producing warfs and causing burrs and undulations, makes it possible to use sectionally deformed band plate feeds in wide applications and so are of great industrial value, as will be appreciated from its advantages as set out below.

(1) The metal band plate feeds are widthwisely stepped by rolling. Thus, noly only can they be used without waste and so with improved yields, but they can also be rolled by opposing work rolls continuously at a certain speed with improved productivity.

(2) By large frictional force occurring in the rolling direction of the metal band plate feeds, some limitation is placed upon their elongation in their rolling direction, so that they can be deformed largely in their widthwise direction with no difference in rolling length between the unrolled and rolled portions. It is thus possible to make sectionally deformed band plate feeds of high quality without causing undulations.

(3) If the metal band plate feeds are reciprocated through a single rolling stand, then they can be rolled by a set of work rolls, even when the final reduction ratio of the sectionally deformed band plate feed to be made exceeds 30%. Further, if provision is made of an arrangement of a plurality of rolling stands in which the gaps between sets of work rolls are designed to narrow gradually in a rolling direction, it is then possible to make sectionally deformed band plate feeds in a given dimension at one feeding operation in one direction with improved production efficiency.

(4) Since a plurality of metal band plate feeds are rolled together between a set of work rolls at a reduction ratio of 30% or lower and at one feeding operation, they are unlikely to be cladded even when they are rolled while overlaid one upon another. Thus, they can be separated and coiled by pay-off and take-up reels or take-up reels with improved productivity.

(5) The use of a rolling stand housing a pair of opposing work rolls having their barrels provided with grooves of the same shape makes it possible to make two sectionally deformed band plate feeds at the same time with doubling productivity.

(6) Since the grooves of the work rolls can be formed easily and inexpensively and the attachment of them to the rolling stand can be effected easily, it is possible to achieve various sectional forms easily.

We claim:

1. A method for making sectionally deformed band plate feeds by cold-rolling plane metal band plate feeds (1) between a set of work rolls (3), wherein at least one of said work rolls (3) has a barrel provided with a circumferential groove (*3a*), a plurality of metal band plate feeds (1) with substantially equal resistance to deformation, while overlaid one upon another, are rolled together between said work rolls (3) at a reduction of 30% or lower at one feeding operation and the resulting metal band plate feeds (1) are separated from each other.

2. A method as claimed in claim 1, wherein said metal band plate feeds (1) are reciprocated through a set of said work rolls (3) and a gap (*3b*) between said work rolls (3) is reduced whenever they are rolled back.

3. A method as claimed in claim 1, wherein said metal band plate feeds (1) are fed in one direction through an arrangement of plural sets of work rolls (3) wherein gaps (*3b*) between the rolls of each set narrow gradually in the feeding direction of said metal band plate feeds (1).

4. A method as claimed in any one of claim 1, wherein a work roll (3) opposite to said work roll (3) having said groove (*3a*) is provided with a groove (*3a*) wherein both grooves are aligned with each other and have equal widths.

5. A method as claimed in any one of claim 1 wherein a work roll (3) opposite to said work roll (3) having said groove (*3a*) is a flat work roll having no groove in its barrel.

* * * * *